United States Patent [19]

Kuo

[11] 4,320,982

[45] * Mar. 23, 1982

[54] WRITING IMPLEMENT

[76] Inventor: Chun-Liang Kuo, No. 328, 2nd Floor, Cheng Yi North Rd., San Chung City, Taipei Hsien, Taiwan

[ * ] Notice: The portion of the term of this patent subsequent to Aug. 26, 1997, has been disclaimed.

[21] Appl. No.: 74,825

[22] Filed: Sep. 12, 1979

Related U.S. Application Data

[63] Continuation-in-part of Ser. No. 919,039, Jun. 26, 1978, Pat. No. 4,219,282.

[51] Int. Cl.[3] ..... B43K 21/16

[52] U.S. Cl. ..... 401/57; 401/65; 401/82; 401/85; 401/90; 401/94

[58] Field of Search ..... 401/57, 62, 65, 67, 401/81, 82–84, 85, 89, 90, 92, 94, 96, 99, 104, 83, 88, 80; 206/627, 3

[56] References Cited

U.S. PATENT DOCUMENTS

| | | | |
|---|---|---|---|
| 480,188 | 8/1892 | Fornander | 401/88 |
| 481,100 | 8/1892 | Boman | 401/89 |
| 584,999 | 6/1897 | Goldsmith et al. | 401/67 |
| 603,183 | 4/1898 | Goldsmith | 401/73 |
| 692,440 | 2/1902 | Goldsmith | 401/65 |
| 866,350 | 9/1907 | Fowler | 401/82 |
| 1,062,274 | 5/1913 | Fischer | 401/84 |
| 1,262,859 | 4/1918 | Smith | 401/89 |
| 2,034,133 | 3/1936 | Dredge | 401/104 X |
| 3,338,215 | 8/1967 | Chiu et al. | 401/87 |
| 3,373,520 | 3/1968 | Into | 206/3 X |
| 3,790,291 | 2/1974 | Hung et al. | 401/57 |
| 3,918,819 | 11/1975 | Liu | 401/57 |
| 4,219,282 | 8/1980 | Kuo | 401/94 X |

FOREIGN PATENT DOCUMENTS

| | | | |
|---|---|---|---|
| 1219785 | 6/1966 | Fed. Rep. of Germany | 206/627 |
| 974993 | 2/1951 | France | 401/94 |
| 1118319 | 6/1956 | France | 401/104 |

*Primary Examiner*—Steven A. Bratlie
*Attorney, Agent, or Firm*—Tak Ki Sung

[57] ABSTRACT

This invention relates to a writing implement comprising an outer casing, a coil spring disposed within the casing, an inner tube inserted through the coil spring and having a plurality of presharpened pieces of pencil lead stored therewithin, and a capping member fitted over the open end of the inner tube. The lower (writing) portion of the inner tube is split into two clamping halves. The lower end of the coil spring is formed into a hook which slides along the slot formed between the clamping halves to allow the expelling and feeding of presharpened pieces of pencil lead into the space between said two clamping halves.

4 Claims, 19 Drawing Figures

WRITING IMPLEMENT

This is a continuation-in-part application of Ser. No. 919,039, filed June 26, 1978, now U.S. Pat. No. 4,219,282.

FIELD OF THE INVENTION

The present invention is related to a writing and drawing pencil, in which the lead can be changed automatically and in which the leads are presharpened, thus requiring no sharpening.

BACKGROUND OF THE INVENTION

Ever since the introduction of "presharpened" pencils in the market, numerous forms and kinds of such pencils have been made available. However, upon further investigation, it is found that the construction of these pencils is not ony very complicated, but also inconvenient in use and have many disadvantages.

The primary objective of the present invention is to provide a special construction in a presharpened pencil in order to facilitate writing, as well as to eliminate the disadvantages of conventional presharpened pencils.

The following are the advantageous characteristics of the present invention:

(1) The present invention adopts the "direct pressing" method in which the user employs a one-handed operation to quickly push out or change the pencil lead for the purpose of writing. The convenience and simplicity of this operation have never been made available. The previous presharpened pencils have never exhibited such desirable characteristics.

(2) While in use, the lead in the present pencil is tightly pressed against the lower end of the pencil so that there is no wobbling or vibrating, thus providing an extremely stable operation.

(3) When changing or refilling the leads in the present pencil, the user's fingers do not come in contact with the somewhat toxic lead. This is one of the most outstanding advantages of the present invention—to prevent the fingers from getting dirty, which is beneficial to the health of the users (e.g. students).

(4) In the present invention, the lead sections do not require lead holders or collars, which means easier manufacturing and lower costs.

(5) The present invention allows the retraction of an exposed lead into the pencil. Thus, there is no need for an additional cap to cover or protect the lead.

(6) Since the construction of the present invention is particularly simple, the parts can easily be made without fabrication by injection molding. As the manufacturing process is simplified, the cost is decreased substantially.

In addition to those described above, the other objectives, effectiveness and features of the present invention are described in detail as follows in conjunction with the appended drawings.

DETAILED DESCRIPTION OF THE PRESENT INVENTION

Figure 1A:
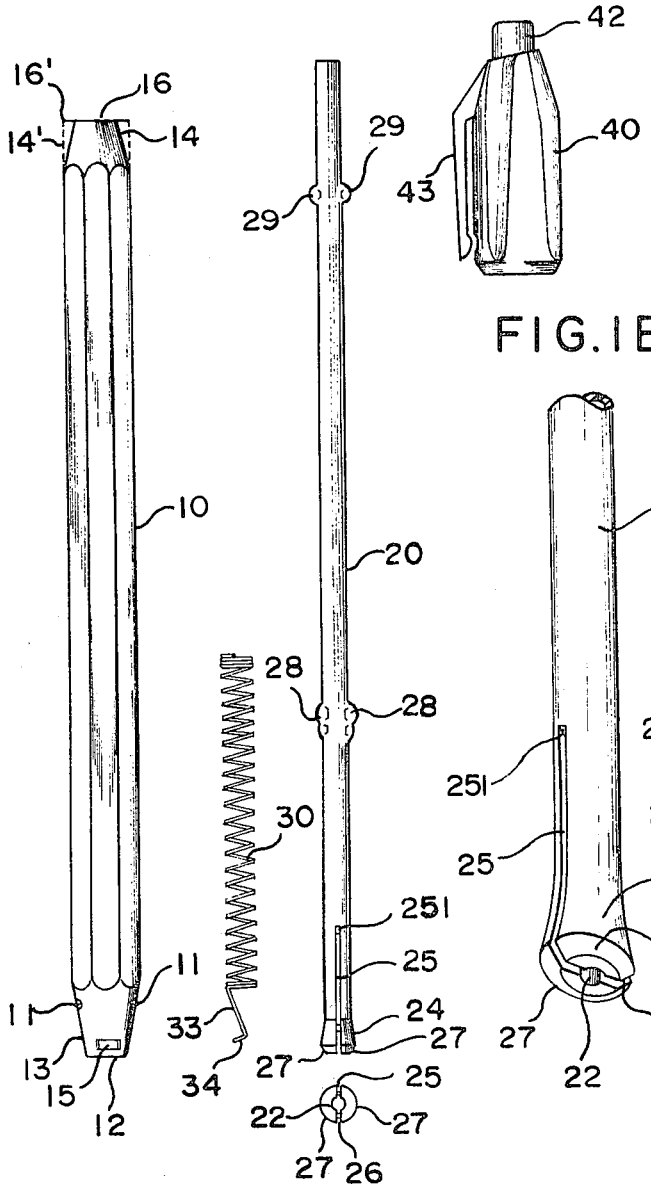
FIG. 1A is a three-dimentional sketch of the separate parts of the first embodiment according to the present invention.
Figures 1B, 1C:
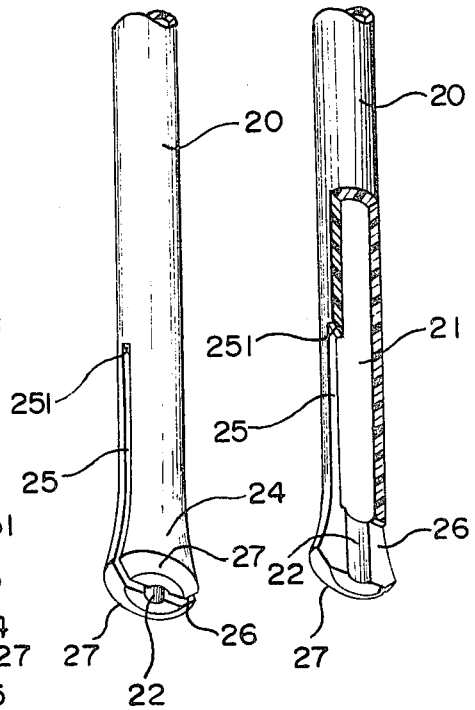
FIG. 1B is a perspective view of the lower portion of the inner tube of the first embodiment according to the present invention.
FIG. 1C is a perspective view of the lower portion of the inner tube of the first embodiment according to the present invention, wherein one of the clamping halves is broken away to reveal the interior of the lower portion of the inner tube.
Figure 2:
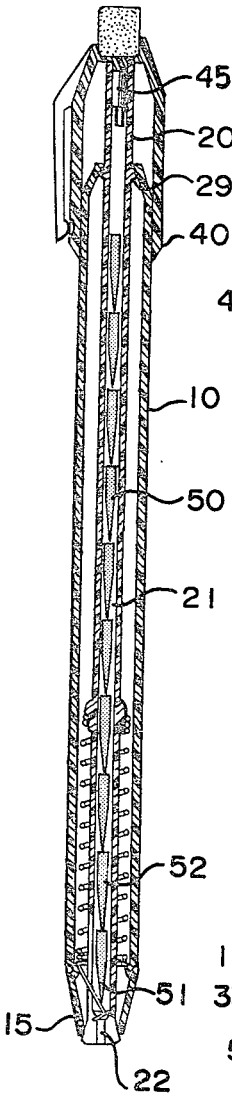
FIGS. 2–6 are cross-sectional diagrams of the first embodiment according to the present invention, showing the various stages of operation in releasing pencil leads.

As shown in FIG. 1A, the first embodiment of the present invention comprises an outer casing 10, a coil spring 30, an inner tube 20 and a capping member 40. The outer casing 10 is made of a hollow round tube by a pipedrawing extrusion method, with the two opposite ends 13, 14 being tapered to form a generally conical shape. Each end has an appropriate opening 12 and 16 respectively, each of said openings has a smaller diameter than that of the casing 10. Two depressions 11—11, the purpose of which will be explained later, are provided near the upper end of tapered end 13. Below the depressions 11—11, there is provided an opening 15, the purpose of which will also be explained later. The interior of the inner tube 20 is provided with a channel 21 in which a plurality of leads 50 (as shown in FIG. 2) are stored. The lowermost end of channel 21 is formed into a lower tube channel 22 having a slightly smaller diameter (FIG. 1C). The smaller diameter of lower tube channel 22 is for preventing the lowermost piece of pencil lead 51 from passing therethrough, so that the leads 50 are held within the inner tube 20. Through the uppermost end of tube channel 21, new leads are fed into inner tube 20. The exterior of the lowermost end of inner tube 20 is enlarged to form conical head 24, which is tapered inwardly towards the longitudinal axis of inner tube 20 to form portions 27 (FIG. 1B). Two slots 25, 26 are made in conical head 24 to form two clamping halves, i.e. to bisect said enlarged conical head 24 into two semi-circular lead clamps 27. Slot 26, formed on the enlarged conical head 24, is shorter and the other slot 25 formed on head 24 and the lower portion of tube 20, is much longer. Slot 26 is about half the length of a presharped lead which is about 1 cm long and slot 25 is about 4 to 6 preferably times the length of slot 26. The closed end of slot 25 has a sloping bottom wall 251 to facilitate the gliding of the hooked tip 34 of coil spring 30 thereon. In addition, two protrusions 28 are provided on the exterior surface of tube 20, at a distance of from about $\frac{1}{3}$ to about $\frac{1}{2}$ of the length of tube 20 from conical clamp 27 (FIG. 1A). The positioning of protrusions 28 can be varied in accordance with the length of coil spring 30 as well as the compression strength of the coil spring. Protrusions 28 comprise two adjacent sets of projections, one having a greater height than the other. The set of projection having a smaller height is located near the writing end of the pencil. This projection is for engaging the upper end of coil spring 30 so that the spring will not slip off inner tube 20 during assembly. Protrusions 28 are for pressing on coil spring 30 when the inner tube 20 is placed within outer casing through coil spring 30. Near the upper end of inner tube 20, two protrusions 29—29 are provided for pressing against the inner surface of the upper end 14 of outer casing 10. Protrusions 29—29 are located about 1 cm from the upper end of tube 20. It is important to note that at the lowermost end of spring 30, the last coil constitutes a lead-pushing member comprising a straight wire 33 and a hooked tip 34 bent outwardly, i.e. away from the interior of tube 20. The length of the hooked tip 34 is larger than that of the outside diameter of the rear blunt end of the pencil lead. Upon inserting inner tube 20 into outer casing 10 through coil spring 30, care is exercised so that hooked tip 34 is aligned with slot 25. That is, when inner tube 20 is inserted through coil spring 30, lead-pushing member 33 at the lower end of coil spring 30 is forced into slot 25, causing tip 34 to extend into the junction between tube channel 21 and front tube channel 22. As a result, tip 34 can either effectively press onto or block against pencil lead 50.

As shown in FIG. 1A, capping member 40 has clip member 43 and eraser block 42. FIGS. 2 through 10 show that capping member 40 is additionally provided with tapered stopper 45. Stopper 45 which is integral with capping member 40 is smaller than inner tube 20 in diameter. Stopper 45 is located on the interior wall of the closed end of capping member 40. In an assembled position, stopper 45 is inserted into the end of tube 20. Capping member 40 is thus slipped over the end of tube 20 to serve as an actuator button for the pencil as well as a cap in order to prevent leads 50 from falling out of tube channel 21.

It should be noted that before the assembling of the present pencil the upper end 14′ of outer casing 10 as indicated in dotted lines in FIG. 1A is as large as the middle portion of the outer casing in diameter. The upper opening corresponding to upper end 14′ is now referred to as 16′. To assemble the present pencil, first, inner tube 20 with the head 24 aligned toward the writing end of the pencil is inserted through the rear end of coil spring 30 until lead-pushing member 33 of coil spring 30 is glided or rotated into alignment with slot 25. Second, inner tube 20 assembled with coil spring 30 is inserted through upper opening 16′ into the lower portion of outer casing 10, with the upper portion of lead-pushing member 33 being tightly fastened onto depressions 11—11 of outer casing 10. As a result, the lower ends of the two lead clamps 27—27 project slightly outside of opening 12 (when the two lead clamps 27—27 containing no pencil lead therein are pressed together, their outside diameter will be slightly smaller than opening 12, therefore they can project out). After the inner tube has been properly inserted, the upper end 14′ of outer casing 10 is heat-pressed inwardly onto the upper projections 29—29 of inner tube 20 to form a smaller upper end 14 so as to firmly secure inner tube 20 within outer casing 10. Capping member 40 is then slipped over upper end 14 by inserting inner stopper 45 into the upper opening of inner tube 20, thereby completing the assembling of the first embodiment of the present invention.

Figure 3:
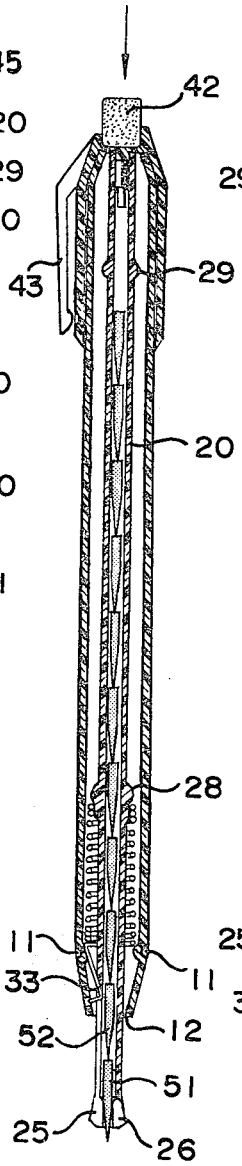
Figure 4:
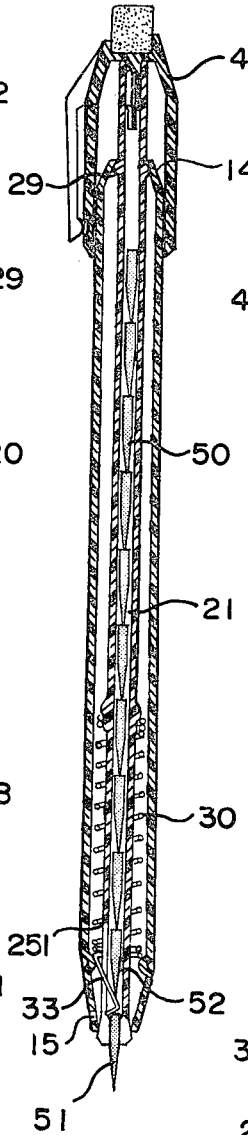
Figure 5:
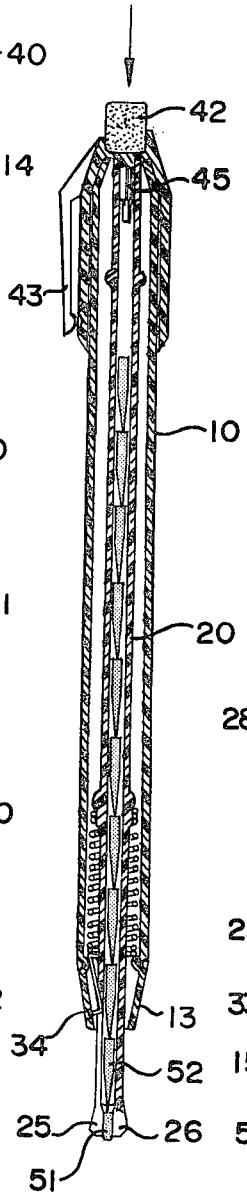
Figure 6:
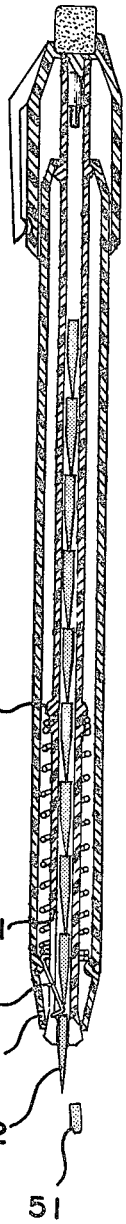
Figures 7, 8, 9, 10:
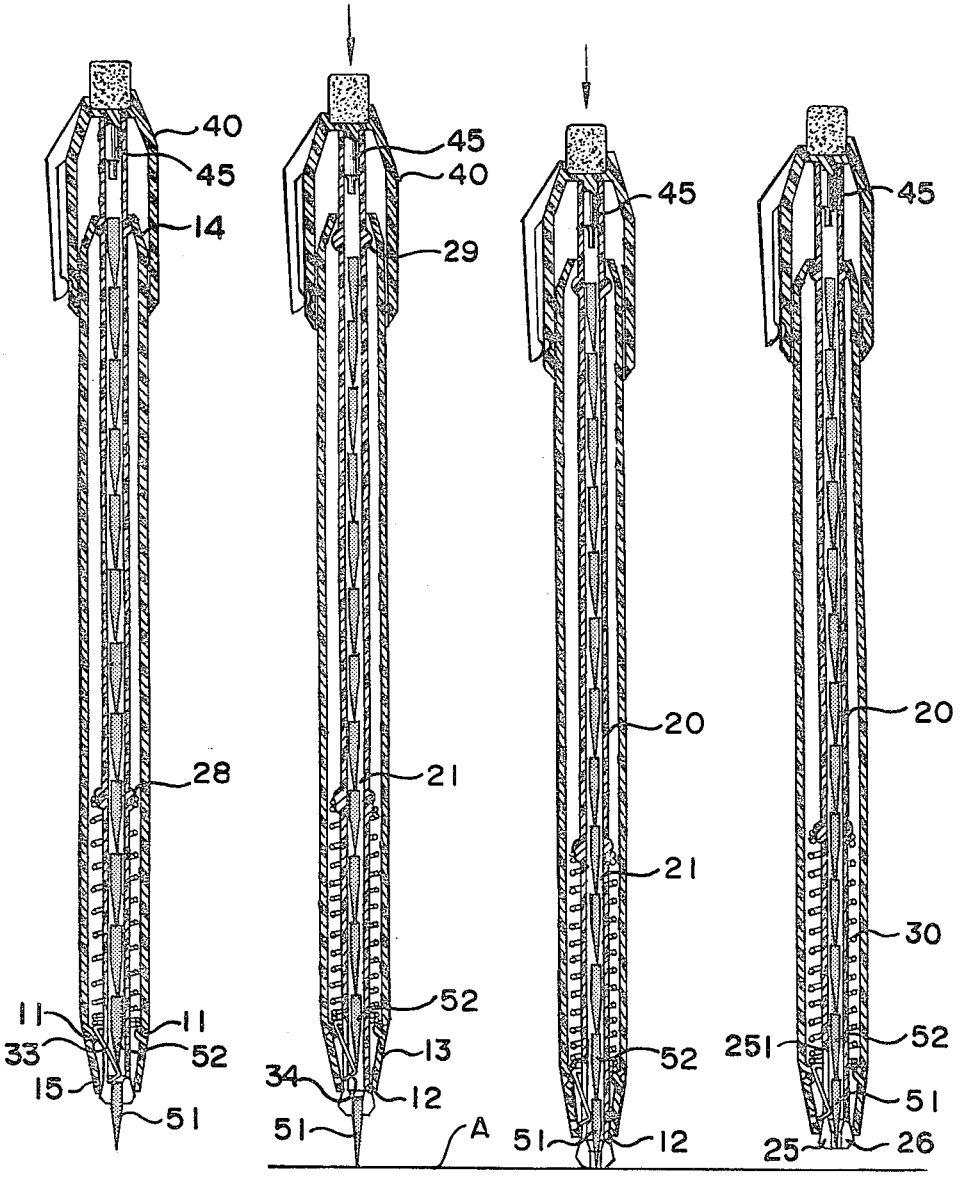
FIGS. 7–10 are cross-sectional diagrams of the first embodiment according to the present invention, showing the various stages of operation in retracting the pencil lead.

FIGS. 2 through 6 show the various stages involved in operating the present pencil. When the tube channel 21 is completely filled with presharpened lead pieces, the capacity is about twelve sections. The lead pieces are stored in a front-to-end fashion with the sharpened end of each piece being pointed towards the writing end of the present pencil. FIG. 2 shows the pencil before being used. When the user starts to press or push capping member 40 downwardly, protrusions 28—28 force coil spring 30 to be compressed, as in FIG. 3. Lead clamps 27 of inner tube 20 are fully projected outside opening 12 of outer casing 10. On the other hand, lead-pushing member 33 of coil spring 30 slides along slot 25 due to the downward shift of lead clamps 27. When lead-pushing member 33 reaches the end wall 251 of slot 25, the hooked tip 34 will be forced to extend into opening 15. At this time, the first piece of pencil lead 51 in inner tube 20 is no longer blocked by lead-pushing member 33 and is subsequently released. It falls automatically through the foremost end of tube channel 21. However, since lowermost tube channel 22 is slightly smaller in diameter than lead 51, the lead is thus retained therein. The point of lead 51 extends through the lowermost tube channel 22 and is exposed to the outside as shown in FIG. 3. The user then removes his finger from capping member 40, thus releasing the pressure. As a result, lead clamp 27—27 of inner tube 20 is withdrawn into the outer casing 10 as coil spring 30 returns to almost its original length. Lead-pushing member 33 is returned to tube channel 21 after gliding through slot 25. Upon further retraction of inner tube 20, member 33 comes into contact with the blunt end of lead 51, thus pushing lead 51 further out of channel 21 into the lowermost end of tube channel 22. When inner tube 20 is returned to its original position (that is, upper protrusions 29—29 are stopped by the inner surface of the upper opening 16 on outer casing 10) the first lead section 51 is pushed completely into the lowermost end of tube channel 22 of inner tube 20, as shown in FIG. 3. As a result of the insertion of lead 51 into lead clamps 27, the outside diameter of the clamps is slightly increased so that said diameter is larger than that of opening 12 of outer casing 10. When the user presses the pencil down onto the writing surface, an upward pressure is exerted, pushing the front end of inner tube into outer casing 10. Since the outside diameter of the clamps is slightly larger than that of opening 12, this inward pressure forces the clamps into opening 12 so as to form an extremely tight grip on exposed lead 51. Thus, there is no wobbling or vibrating in lead 51, which leads to a very stable writing or drawing operation. When the first section of lead 51 has become blunt due to use and has to be replaced by second lead section 52, the above process may be repeated by pressing down on capping member 40, making the two lead clamps 27—27 extend out of outer casing 10 as shown in FIG. 5. By releasing the pressure, the lead-pushing member 33 pushes the second section of lead 52 into channel 22, which pushes the blunt used lead 51 completely out of inner tube 20. However, since lead clamps 27—27 are still partially open when lead 51 is expelled, the removal of lead 51 is easily performed, without any damage to the point of lead 52 (see FIG. 6). The above description is detailed particularly for the sake of understanding the working principle of the present invention. It should be noted that during actual use, the pushing and releasing movements are continuous and rapid, and that little exertion in handling and operation is required of the user.

In the present invention, the pencil lead, used or not used, can be withdrawn into the inner tube 20. The stages of withdrawing the pencil lead are shown in FIGS. 7 through 10. The user simply puts the front end of an exposed pencil lead against any surface such as a table top and presses capping member 40 lightly to have the two lead clamps 27—27 project slightly outside of opening 12 of outer casing 10 to form an opening. In the meantime, the rear blunt portion of the exposed lead forces hooked tip 34 of lead-pushing member 33 away into opening 15 and the lead enters tube channel 21. In other words, since the length of hooked tip 34 is larger than that of the outside diameter of the rear blunt end of the pencil lead, the rear blunt end of the exposed lead can slide along the hooked tip to re-enter inner tube 20. Thus, as the pressure is released, the entire lead section is withdrawn into the tube channels 21 and 22. Therefore, the present invention has the additional advantage of requiring no protective cap or cover for the lead.

In the event that it is not desired to have the lead retracting feature in the present invention, this can be accomplished by replacing the hooked tip 34 with a straight portion.

Figure 11:
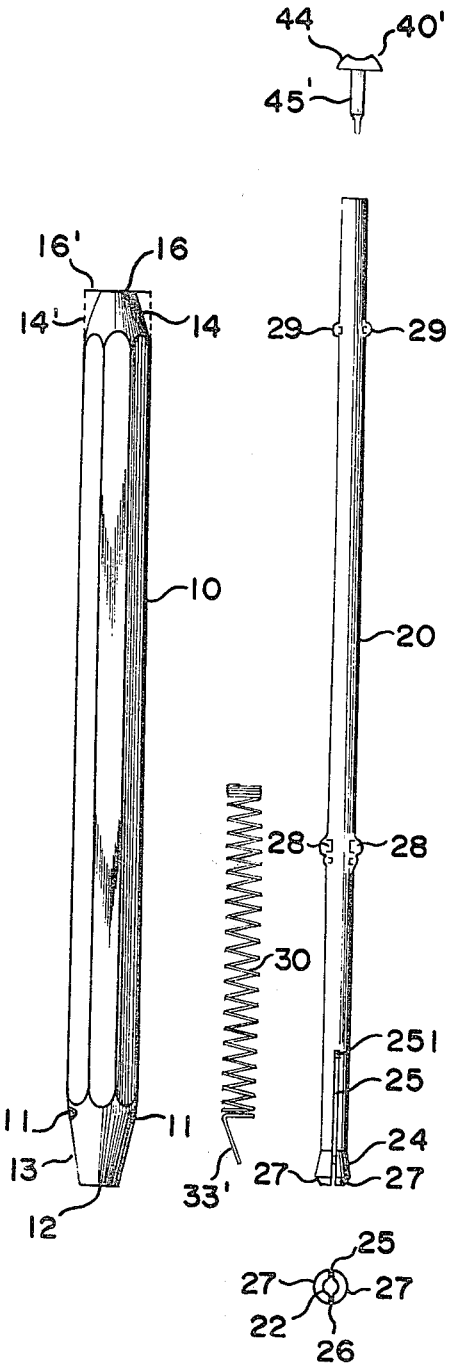
FIG. 11 is a three dimentional sketch of the separate parts of the second embodiment according to the present invention.
Figure 12:
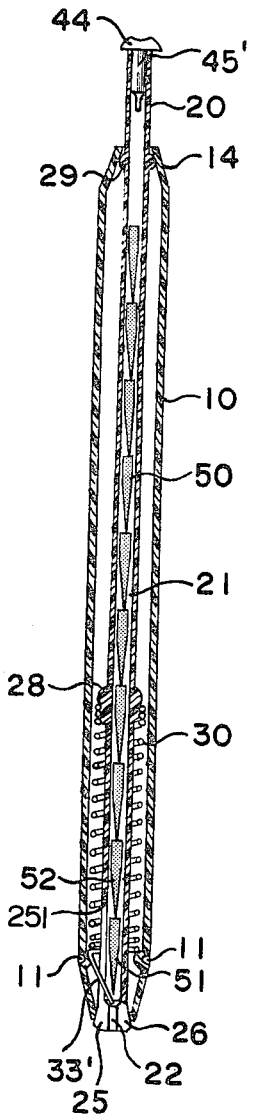
FIG. 12 is a cross-sectional view of the second embodiment according to the present invention.
Figure 12A:
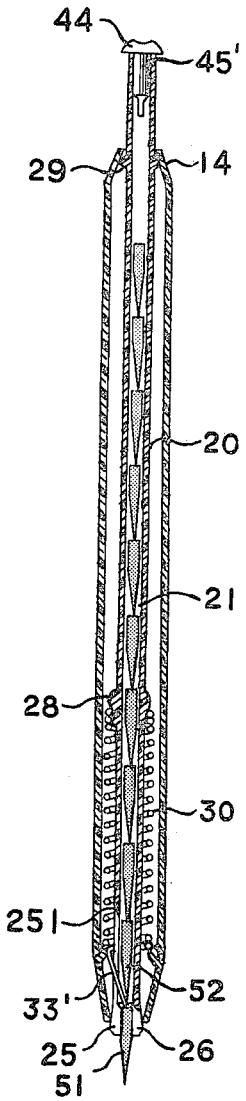
FIG. 12A is a cross-sectional view of the second embodiment according to the present invention, with the lead exposed.

Shown in FIG. 11 is the second embodiment of the present invention. It differs from the above embodiment in that first, the lead-pushing member 33' has no provision of a hooked tip; second, the capping member 40' comprises a head 44 and a tapered stopper 45'. Since this embodiment does not have the lead retracting feature, it requires almost the same operation as the first embodiment to release the pencil leads for use. Therefore, it is not necessary to describe the detailed stages of operation of this embodiment here. FIGS. 12 and 12A show the cross-sectional views of the present invention when the lead is not exposed and exposed, respectively.

Figures 13, 14, 15, 16:
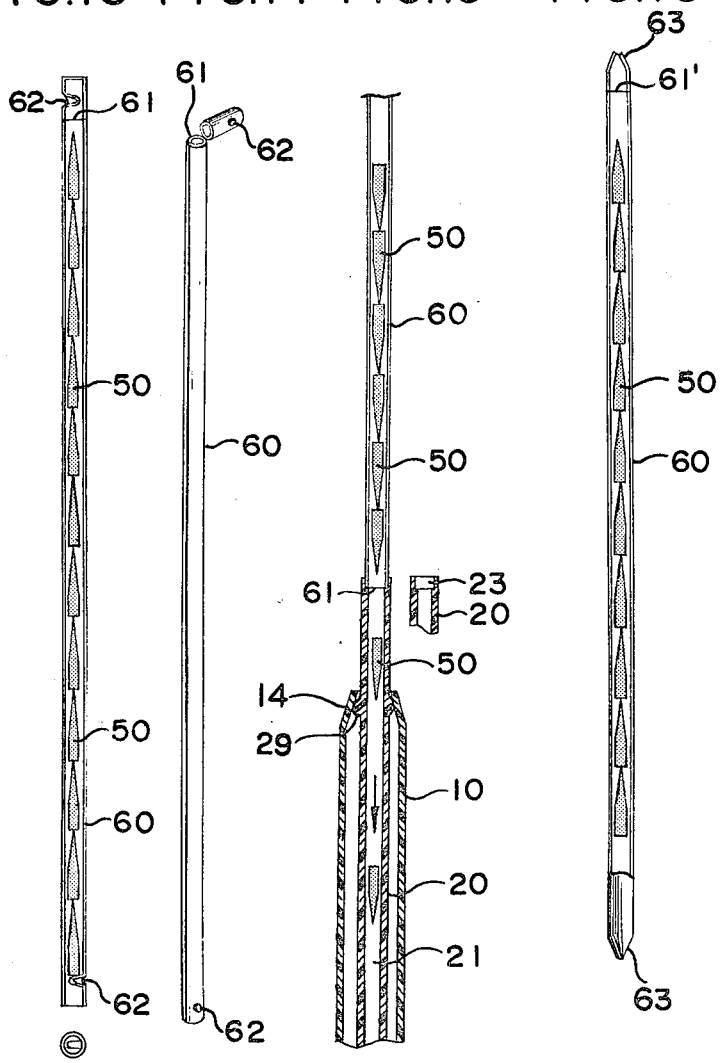
FIG. 13 is a diagram of the first embodiment of a cartridge according to the present invention.
FIGS. 14 and 15 are diagrams of the first embodiment of the cartridge according to the present invention, showing how to feed fresh pieces of pencil lead into the emptied inner tube.
FIG. 16 is a diagram of the second embodiment of the cartridge according to the present invention.

FIG. 13 shows an embodiment of a plastic spare tube 60 filled with a plurality of presharpened pencil leads. As shown in FIG. 13, each of the opposite ends of the spare tube 60 is pressed to form a depression 62 so as to prevent the pencil leads from falling out of the tube. Furthermore, spare tube 60 is scored at 61 below depression 62 toward which the pencil leads point. Spare tube 60 is smaller in diameter than inner tube 20. As shown in FIGS. 14 and 15, by breaking away the upper end of spare tube 60 at 61 and then inserting the opened end of spare tube 60 into the upper opening 23 of the inner tube 20, the lead pieces 50 will fall into inner tube 20 one by one so as to fill it completely, as shown in FIGS. 2 and 12. FIG. 16 shows another embodiment of the spare tube. It differs from the above embodiment only in that it has two opposite ends 63 heat-pressed in a convergent manner. And score line 61' is provided below end 13 toward which the presharpened lead pieces point. According to these two embodiments of spare tube 60, the filling of new pencil leads can be done conveniently and without dirtying the user's fingers. However, should one prefer, the lead may be inserted individually into inner tube 20 without using plastic spare tube 60.

The lead section used in the present invention will not be limited to pencil lead. Other working implements which can utilize the construction of the present invention and, therefore, are within the scope hereof including colored pencils, crayons, paraffin pencils, and the like.

What is claimed is:

1. A writing implement comprising:

an outer casing having a converging lower end which is provided with a plurality of depressions near the top of the converging lower end;

a coil spring disposed within the outer casing, the coil spring having a free end and the other end being formed into a lead-pushing member comprising a straight wire, the lower end of the coil spring engaging the depressions provided near the converging lower end of the outer casing;

an inner tube inserted into the outer casing and through the coil spring, the inner tube having an inside channel for storing a plurality of presharpened leads therein, the lowermost end of the inner tube being formed into conical clamp portions having two diametrically opposed slots extending from the lower open end and along the longitudinal axis of the inner tube, the slots having different lengths, the first slot being about $\frac{1}{2}$ the length of a presharpened pencil lead, the second slot being about four to six times the length of the first slot, the end wall at the closed end of the second slot being slanted, the wall slanting upwardly toward the upper end of the inner tube, the inside diameter of the inner tube being reduced at the lowermost end by an amount sufficient to frictionally withhold the leads therein, a first set of protrusions being disposed near the upper end of the inner tube to press against the inner surface of the upper end of the outer casing, the upper end of the outer casing being pressed in a convergent manner after the inner tube and the coil spring have been inserted into the outer casing, a second set of protrusions disposed at a distance of from about $\frac{1}{3}$ to $\frac{1}{2}$ the length of the inner tube; and a capping member adapted for covering the upper ends of the outer casing and inner tube.

2. The writing implement of claim 1 wherein the second set of protrusions disposed on the inner tube comprises two adjacent sets of projections of different heights the first set having a shorter height and being located near the lower end of the inner tube, the second set having a greater height and being located near the upper end of the inner tube, the height of the first set of projections being sufficient to engage the inside circumference of the upper end of the coil spring, thus preventing the falling off of the coil spring when the inner tube is inserted through the coil spring.

3. The writing implement of claim 1 wherein the capping member comprises an eraser block fitted into the upper end of the capping member, a clip portion formed integrally with the capping member, and a stopper portion formed integrally with the capping member and disposed on the interior wall of the closed end of the capping member, the stopper portion being smaller in diameter than the inner tube.

4. The writing implement of claim 1 wherein the capping member comprises a head portion and a stopper portion, the stopper portion being smaller in diameter than the inner tube.

* * * * *

UNITED STATES PATENT AND TRADEMARK OFFICE

CERTIFICATE OF CORRECTION

PATENT NO. : 4,320,982

DATED : March 23, 1982

INVENTOR(S) : Chun-Liang Kuo

It is certified that error appears in the above—identified patent and that said Letters Patent is hereby corrected as shown below:

Column 2, line 63, after "preferably", insert -- five --.

Column 5, line 56, change "13" to -- 63 --.

Signed and Sealed this

*Twenty-sixth* Day of *October 1982*

[SEAL]

*Attest:*

GERALD J. MOSSINGHOFF

*Attesting Officer*

*Commissioner of Patents and Trademarks*